US005253798A

United States Patent [19]

Lombardo

[11] Patent Number: 5,253,798

[45] Date of Patent: Oct. 19, 1993

[54] PRESSURE SEAL ADHESIVE PATTERN FOR IBM 3800 PRINTERS

[75] Inventor: Leo Lombardo, Manchester, N.H.

[73] Assignee: Moore Business Forms, Inc., Grand Island, N.Y.

[21] Appl. No.: 824,408

[22] Filed: Jan. 23, 1992

[51] Int. Cl.[5] ..... B65D 27/34; B65D 27/10

[52] U.S. Cl. ..... 229/92.1; 229/314

[58] Field of Search ..... 229/92.1, 92.3, 314

[56] References Cited

U.S. PATENT DOCUMENTS

| | | | |
|---|---|---|---|
| 282,920 | 8/1883 | Plimpton | 229/80 |
| 1,108,540 | 8/1914 | Ahlquist | 229/80 |
| 3,837,565 | 9/1974 | Johnsen | 229/92.1 |
| 4,239,114 | 12/1980 | Denay | 229/314 |
| 4,706,878 | 11/1987 | Lubotta et al. | 229/92.3 |
| 4,877,177 | 10/1989 | Felix | 229/92.3 |
| 4,889,278 | 12/1989 | Steidinger | 229/92.1 |
| 4,896,823 | 1/1990 | Taylor | 229/92.3 |
| 4,898,323 | 2/1990 | Chen et al. | 229/92.3 |

FOREIGN PATENT DOCUMENTS

| | | | |
|---|---|---|---|
| 2252792 | 6/1975 | France | 229/92.1 |

*Primary Examiner*—Stephen P. Garber
*Attorney, Agent, or Firm*—Nixon & Vanderhye

[57] ABSTRACT

A folded (e.g., Z-folded) mailer type business form is constructed so that it may be printed using an IBM 3800 printer without sticking to the printer fuser or backer rolls. Pressure sensitive adhesive patterns (e.g., discontinuous strips) are placed on the first face of a paper sheet near a first transverse edge, and the second face of the paper sheet near a second transverse edge. The spacings from the edge are about 5/16 inches in each case, sufficient to insure that the adhesive is not engaged by the printer rolls during pausing of the printer.

16 Claims, 3 Drawing Sheets

PRESSURE SEAL ADHESIVE PATTERN FOR IBM 3800 PRINTERS

BACKGROUND AND SUMMARY OF THE INVENTION

The conventional mailer forms used in the Moore Business Forms, Inc. Speedisealer® equipment, sold under the trademark Speedisealer®, have proven to be very simple and efficient to use. Typically the forms are fed through a laser printer in sheet or continuous format with variable printing being applied to one side, or typically both sides, and then the forms are burst, the tractor guide portions are slit, and individual sheets are then folded and pressure sealed.

While the conventional forms in the Moore Speedisealer® pressure seal system have been very effective, there has been one substantial problem when utilized with certain types of printers, such as the IBM 3800 printers. When conventional mailer forms with pressure adhesive are utilized with the 3800 printer, the forms sometimes jump out of time, warp the fuser rolls of the printer, and cause other problems.

Upon close inspection of the cooperation between the IBM 3800 printers and the conventional pressure seal forms, the source of the problems discussed above has been identified. The IBM 3800 printer operates in such a way that it pauses at regular intervals. When the printer pauses, it has been found that an impression is created ¼ inch on either side of the fold perforations between forms in the continuous web. Since there is adhesive in that impression area, the forms are caused to stick to the fuser roll and/or the backup roller. This then results in the forms jumping out of time, warping of the fuser rollers, etc., as described above.

According to the present invention, the problem described above has been solved in a simple yet effective manner. According to the present invention, the adhesive patterns on the form have been changed so that they do not interfere with the rollers of the printer used to process the mailers. That is, on both the front and back of the form, the adhesive patterns which are conventionally located 1/16 inch from the leading and trailing edges of the individual forms in the continuous web are repositioned so that they are 5/16 inch away from the leading and trailing edges. This repositioning does not adversely affect the action on the forms in the Moore Speedisealer® pressure seal equipment nor the integrity of the final mailers produced, yet allows the mailers to be processed without the problems discussed above.

According to one aspect of the present invention a method of forming a mailer type business form from a sheet of paper having first and second faces (and typically being a continuous web) using an IBM 3800 printer having fuser and backup rollers is provided. The method comprises the following steps: (a) Forming first and second longitudinal lines of weakness in the sheet parallel to and adjacent, but spaced from, the first and second longitudinal edges, respectively, the lines of weakness defining, with the longitudinal edges, longitudinal marginal portions. Forming first and second transverse fold lines in said sheet to form the first, second, and third sections. (c) Providing matching longitudinal patterns of pressure sensitive adhesive in the longitudinal marginal portions. (d) Providing transverse patterns of pressure sensitive adhesive (e.g., first, second, third and fourth transverse patterns of pressure sensitive adhesive on the sheet, the first and third on the first face, and the second and fourth on the second face), so that the first and third patterns and second and fourth patterns cooperate with each other when the sheet is folded about the fold lines, and so that none of the transverse adhesive patterns are engaged by the fuser and backer rollers during pausing of the printer. (e) Passing the sheet through the 3800 printer to effect printing thereof. (f) Folding the sheet about the fold lines so that all the corresponding patterns of adhesive cooperate with each other. And, (g) Applying pressure to the sheet at the adhesive strips to activate the pressure sensitive adhesive and seal the sheet into a mailer.

Typically the sheet is in continuous web format in which case there is the further step (h), between steps (e) and (f), of bursting the continuous web into individual sheets. The sheet also typically has tractor holes along the longitudinal edges thereof and step (e) is practiced by feeding the sheet through the printer using the tractor holes. There is also the further step (i), after step (e), of slitting the sheet adjacent the longitudinal edges to remove the tractor hole containing portions. Prefolding step (f) is preferably Z-folding.

The invention also relates to a mailer type business form. The form has the following elements: A folded paper sheet having first and second faces, first and second opposite longitudinal edges, and first and second transverse fold lines defining first, second and third sections of the sheet. First and second longitudinal lines of weakness forming with the longitudinal edges first and longitudinal marginal portions. A first transverse edge and a second transverse edge, both parallel to the first and second fold lines. Longitudinal patterns of adhesive disposed in the longitudinal marginal portions for holding the marginal portions of the first through third sections together. At least one of first and second transverse patterns of adhesive disposed adjacent at least one of the first and second transverse edges on the first face and first section, and second face and second section, respectively; and at least one of the the first and second transverse patterns of adhesive being spaced from its associated transverse edge a distance sufficient to insure that the adhesive does not interfere with rollers of a printer used to process the mailer. Preferably both the first and second transverse patterns of adhesive are provided, and are each spaced from the first and second transverse edges, respectively, about 5/16 inches, and the sheet is Z-folded. The first and second transverse patterns of adhesive are typically discontinuous strips, although other patterns may be provided.

The transverse adhesive patterns are typically pressure sensitive adhesive, and third and fourth transverse patterns are also provided for cooperating with the first and second patterns to hold the mailer together. The third pattern is formed on the first face, second section, adjacent the second transverse fold line, and the fourth pattern is formed on the second face, second section, adjacent the first transverse fold line.

It is a primary object of the present invention to provide a method of forming a mailer type business form including printing using an IBM 3800 printer without substantial operational difficulties, and to provide a mailer type business form that is simply and effectively produced. This and other objects of the invention will become clear from an inspection of the detailed description of the invention, and from the appended claims.

DETAILED DESCRIPTION OF THE DRAWINGS

Figure 2:
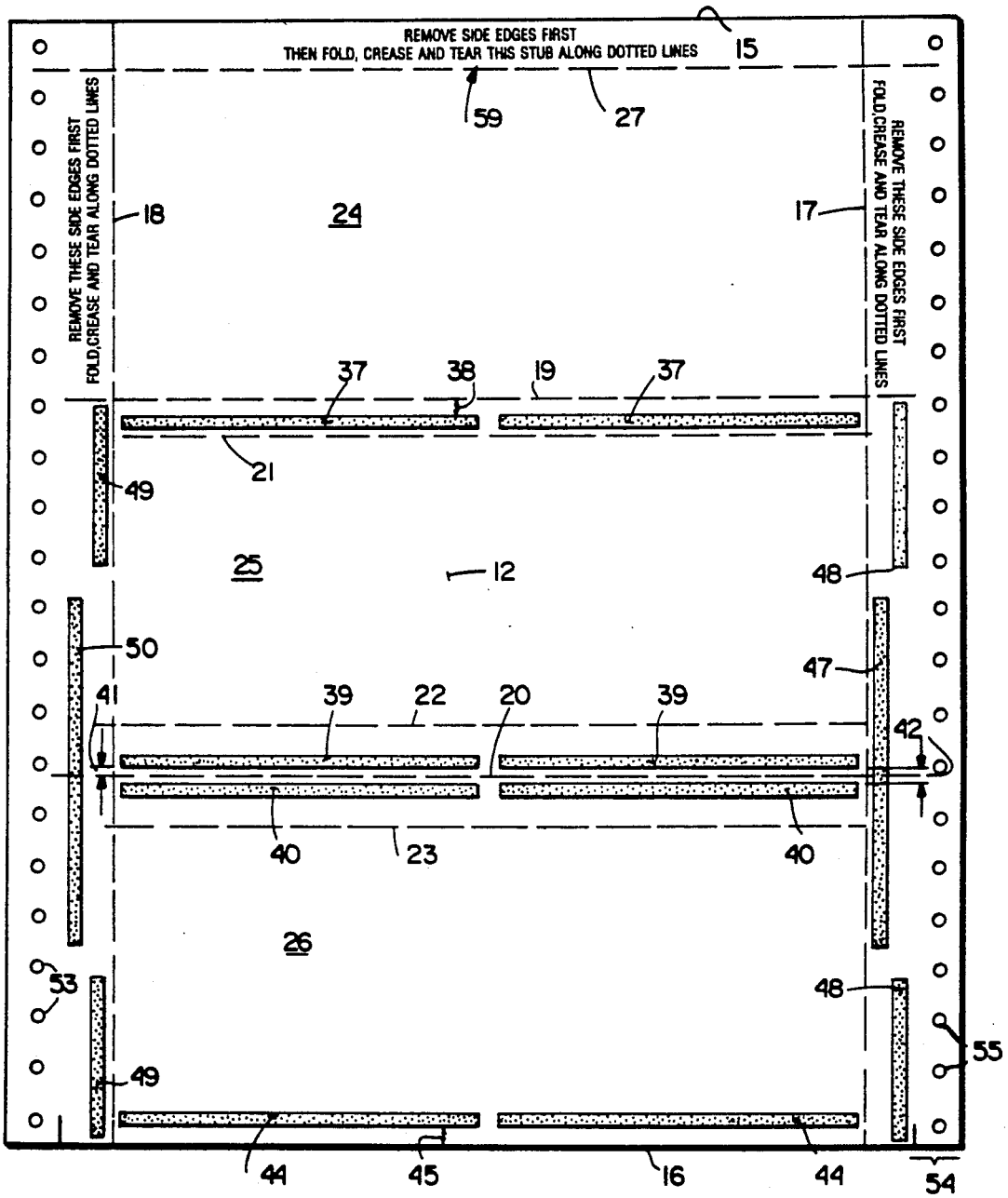
FIG. 2 is a bottom plan view of the mailer intermediate of FIG. 1.
Figure 3:
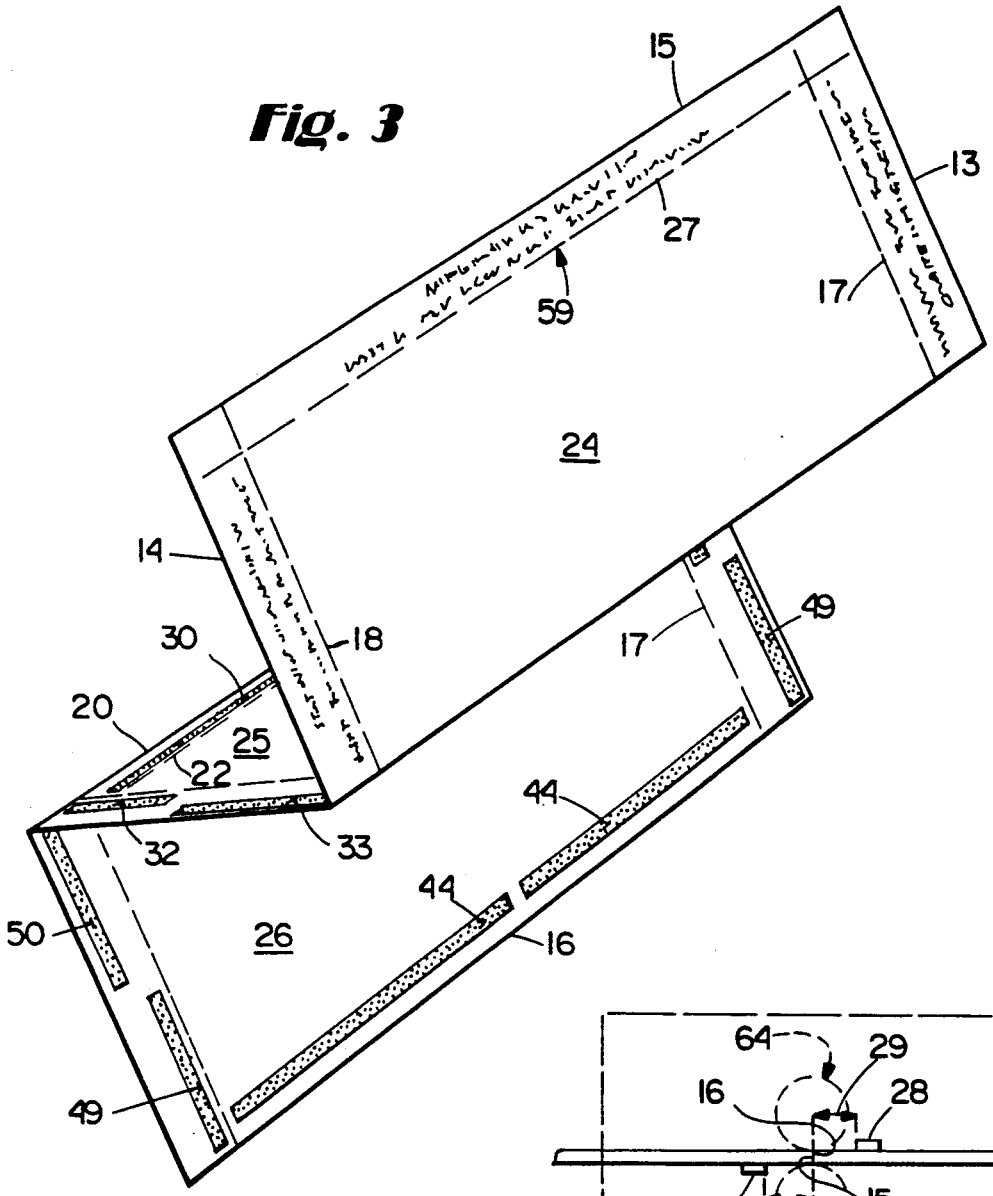
FIG. 3 shows the intermediate of FIGS. 1 and 2 after slitting to remove the side tractor feed holes, and as it is being Z-folded to produce a final mailer.

A mailer type business form, as illustrated in FIG. 3, is produced from a folded (preferably Z-folded) paper sheet 10 having first and second faces 11, 12 (FIGS. 1 and 2, respectively), first and second opposite longitudinal edges 13, 14 (formed by slitting the intermediate of FIGS. 1 and 2), and first and second opposite transverse edges 15, 16. The transverse edges 15, 16 are typically connected to like sheets 10 in continuous web format during processing of the form by an IBM 3800 printer, but the sheets 10 are burst from the continuous web along perforations at the transverse edges 15, 16. The sheets 10 also comprise longitudinal lines of weakness (such as perforations) 17, 18 parallel to the longitudinal edges 13, 14, and first and second transverse fold lines 19, 20, respectively, parallel to the transverse edges 15, 16. Transverse lines of weakness 21, 22 also are preferably provided spaced about ½ of an inch from the transverse fold lines 19, 20, the lines of weakness 21, 22 preferably being perforations.

The transverse fold lines 19, 20 divide the sheet 10 into first, second, and third sections 24, 25, and 26, respectively. The third section 26 is typically the section having the address area for the mailer produced from the sheet 10. The spacing between the first transverse fold line 19 and the line of weakness 21 is about ½ of an inch, while the spacing between each of the lines of weakness 22, 23 and the second transverse fold line 20 is ½ inch respectively.

Adjacent the first transverse (leading) edge 15 there preferably is provided a transverse line of weakness (e.g., perforation) 27, parallel to the edge 15 and spaced between about ½ inch from the edge 15. Between the line of weakness 27 and the first transverse edge 15 is an adhesive pattern, such as the discontinuous transverse strip 28, which is parallel to the edge 15. While heat activated adhesive may be utilized for the adhesive pattern 28, preferably it is conventional pressure sensitive adhesive used with the Moore Speedisealer® pressure seal equipment, as on the conventional Moore Sealermate® Z-folded pressure seal system form. One example of such an adhesive is that marketed by Topan Moore of Japan under the trade designation TM-124, which is a styrene-natural rubber copolymer. Another commercially available adhesive that may be utilized is the Fuller HL-9016 adhesive.

According to the present invention, the adhesive pattern 28 is spaced from the edge 15 a distance 29 which is sufficient to insure that the pattern 28 does not interfere with the fusion or backup rollers of an IBM 3800 printer during pausing of the printing in its natural timing sequence. In conventional Sealermate® pressure seal forms, the spacing of the adhesive patterns 28 from the edge 15 is only about 1/16 of an inch, which has been found according to the invention to result in engagement of the adhesive with the backup and/or fusion rollers during pausing of the printer, and subsequent problems. According to the invention, the spacing 29 is approximately 5/16 of an inch. This is sufficient to avoid engagement of the fusion or backup rollers with the strips 28 when the printer pauses. Yet the spacing 29 is not significant enough so as to adversely affect the integrity of the final mailer produced. With such a spacing 29, the final mailer is still sufficiently integral and secure after pressure sealing that no operational or aesthetic problems are associated with the mailer.

The face 11 also includes a transverse pattern (e.g., discontinuous strip) 30 of adhesive (typically pressure sensitive adhesive) spaced a distance 31 from the second transverse fold line 20, and second section 25. The spacing 31 is different from that in a conventional form, having been adjusted to accommodate the shifting of the pattern 28 (and a like pattern on the opposite face 12 to be hereafter described). Typically, the distance 31 is about ¼ inch, that is the pattern 30 is about 1/16 inch away from the transverse tear-off perf 22.

Figure 1:
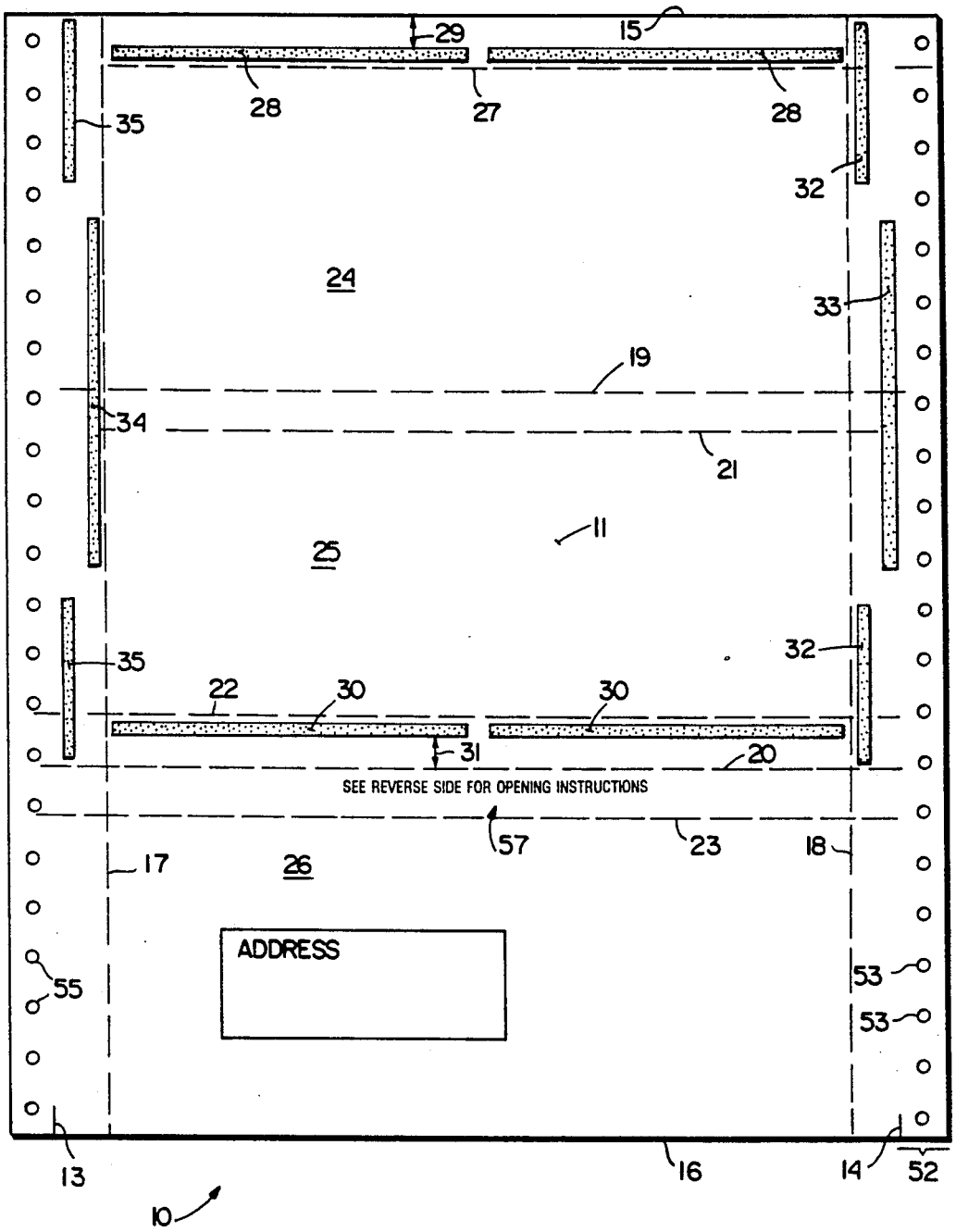
FIG. 1 is a top plan view of a mailer intermediate according to the present invention.

Longitudinal strips of adhesive are also disposed on the sheet 10 face 11. They are disposed in the longitudinal marginal portions formed between the first and second longitudinal lines of weakness 17, 18 and the first and second longitudinal edges 13, 14. As illustrated in FIG. 1, the longitudinal patterns 32, 33—spaced transversely from each other, in the form of integral or discontinuous strips—are provided in the longitudinal portion adjacent the second longitudinal line of weakness 18, while similar patterns 34, 35 are disposed adjacent the first longitudinal line of weakness 17.

On the face 12 (FIG. 2) other transverse adhesive patterns are provided. For example, the patterns (discontinuous strip) 37 are provided in the first section 24, spaced a distance 38 which is preferably about 5/16 inch away from the first transverse fold line 19. Transverse patterns 39, 40 are provided in the second and third sections 25, 26, respectively, each spaced about 1/16 inch from the second transverse fold line 20, as indicated by the spacings 41, 42. A transverse pattern (in the form of a discontinuous strip 44) is also provided adjacent the second (trailing) transverse edge 16, the pattern 44 being spaced a distance 45 from the edge 16, which preferably is about 5/16 of an inch, and in any event is sufficient to prevent the IBM 3800 printer fuser backup rollers engaging the pattern 44 during pausing. On the face 12 are also further longitudinal patterns which cooperate with each other to effect holding of the final mailer together, in the form of the patterns 47, 48 in the longitudinal margin adjacent the first longitudinal line of weakness 17, and patterns 49, 50 adjacent the second longitudinal line of weakness 18. All of the patterns 37, 39, 40, 44, and 47 through 50 are preferably pressure sensitive adhesive as described above with respect to the pattern 28.

Normally the paper sheet 10—as indicated above—is part of a continuous web (see FIG. 4) during processing by an IBM 3800 printer. This is accomplished by providing a longitudinal drive portion 52 having openings 53 therein (see FIG. 1) and the longitudinal drive portion 54 having tractor holes 55 therein. As is conventional, after processing through the printer, the portions 52, 53 are removed to form the longitudinal edges 13, 14 by slitting.

The sheet 10 also has various instructional indicia thereon, such as the indicia 57 (FIG. 1) and 59 (FIG. 2).

Note that all of the adhesive patterns/strips provided with the sheet 10 align with each other to produce the final mailer. The longitudinal strips/patterns 32 through 35 and 47 through 50 are disposed in such a way that at no point do the marginal portions have a double thickness of adhesive when the sheet 10 is flat (that is, the patterns 32, 33 do not overlie the patterns 49, 50 and the patterns 34, 35 do not overlie the patterns 47, 48). However, when the sheet 10 is Z-folded—as illustrated in FIG. 3—to produce the completed mailer, the adhesive portions 32 will align with each other, each half of the portion 33 will align with the other half, and likewise for the portions 34, 35, and 47 through 50. When the forms are thus run "longitudinally" and folded, through the conventional Speedisealer® pressure seal equipment, a positive adhesive seal will be provided.

As can be determined by viewing FIG. 3, in the final mailer a pattern 44 will align with the pattern 37, the patterns 39 and 40 will be aligned, and the patterns 28 and 30 will align, and be positively sealed by the pressure seal equipment. Once the final mailer is produced, and received by the ultimate user, access to the mailer contents is gained by separating the mailer components along the lines of weakness 17, 18, 27, 21 through 23.

Figure 4:
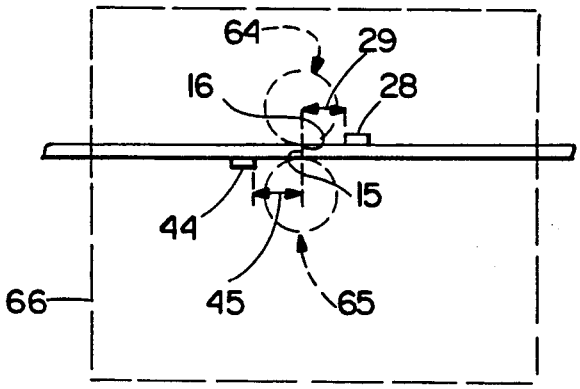
FIG. 4 is a side schematic view showing the positions of pressure seal adhesive strips adjacent the trailing and leading edges of consecutive continuous forms during pausing an IBM 3800 printer.

FIG. 4 illustrates, in schematic form, the pausing of an IBM 3800 printer 66 while processing sheets 10 in continuous format. In FIG. 4 the fuser and backup rollers are illustrated in dotted line and schematically by reference numerals 64 and 65. Note that the spacings 29, 45 of the adhesive patterns 28, 44, respectively, are sufficient so that during this pause the strips 28, 44, will not be engaged by the rollers 64, 65. When the rollers 64, 65 engage the strips 28, 44 while the printer is operating, during normal operation, there is insufficient contact to result in problems. However, if the printer 66 is in a pause mode and the rollers 64, 65 engage the strips 28, 44, sufficient adhesive will be transferred so as to result in the forms jumping out of time, or warping of the rolls 64, 65, etc., due to at least limited sticking action of the adhesive to the rollers 64, 65. As can be seen in FIG. 4, this problem is avoided according to the invention.

The invention not only relates to the mailer 34 described with respect to FIGS. 1 through 3, but also a method of forming that mailer from a sheet 10 of paper having first and second faces 11, 12 utilizing an IBM 3800 printer 66 having fuser and backup rollers (64, 65). The method comprises the following steps:

a) forming first and second longitudinal lines of weakness (17, 18) in the sheet (10) parallel to and adjacent, but spaced from, the first and second longitudinal edges (13, 14), respectively, the lines of weakness (17, 18) defining, with the longitudinal edges (13, 14), longitudinal marginal portions (52, 54);

(b) forming first and second transverse fold lines (19, 20) in the sheet (10) to form the first (24), second (25), and third (26) sections;

(c) providing matching longitudinal patterns (e.g., 32–35) of pressure sensitive adhesive in the longitudinal marginal portions;

(d) providing a plurality of transverse patterns of pressure sensitive adhesive (e.g. first (28), second (44), third (30) and fourth (37) transverse patterns) on the sheet (e.g., the first (28) and third (30) on the first face (11), and the second (44) and fourth (37) on the second face (12), so that the first (28) and third (30) patterns and second (44) and fourth (37) patterns cooperate with each other when the sheet is folded about the fold lines), so that none of the transverse adhesive patterns (28, 30, 37, 39, 40, 44) are engaged by the fuser and backer rollers (64, 65) during pausing of the printer;

(e) passing the sheet (10) through the 3800 printer (66) to effect printing thereof;

(f) folding (preferably Z-folding) the sheet (10) about the fold lines (19, 20) so that all the corresponding patterns (28, 30, 37, 39, 40, 44) of adhesive cooperate with each other (see FIG. 3); and (g) applying pressure to the sheet (10) at the adhesive strips to activate the pressure sensitive adhesive and seal the sheet into a mailer, typically by using a conventional Moore Speedisealer® pressure seal system.

The sheet (10) is preferably in continuous web form during processing by the printer 66 (see FIGURE 4), and there is the further step (see h), between steps (e) and (f) of bursting the continuous web into individual sheets (along transverse edges 15, 16).

The sheet 10 also has tractor holes 53, 55 disposed along the longitudinal edges thereof during feeding through the printer, and therefore step (e) is practiced by feeding the sheet through the printer 66 using the tractor holes 53, 55, and there is the further step (i), after step (e) of slitting the sheet 10 adjacent the longitudinal edges 13, 14 to remove the tractor hole containing portions 52, 54.

Step (d) is practiced by forming the first transverse pattern 28 so that it is on the first face 11 and spaced about 5/16 inch from the leading transverse edge 15 of the sheet 10, prior to bursting, and by forming the second transverse pattern 44 so that it is on the second face 12 and spaced about 5/16 inch from the trailing transverse edge 16 of that sheet prior to bursting.

It will thus be seen that according to the present invention an improved method of forming a mailer type business form from a sheet of paper using an IBM 3800 printer has been provided, as well as a mailer produced according to that method.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent methods and structures.

What is claimed is:

1. A mailer type business form processed by a printer having rollers, and operated to occasionally pause, the mailer comprising:

a folded paper sheet having first and second faces, first and second opposite longitudinal edges, and first and second transverse fold lines defining first, second and third sections of said sheet;

first and second longitudinal lines of weakness forming with said longitudinal edges first and second longitudinal marginal portions;

a first transverse edge and a second transverse edge, both parallel to said first and second fold lines;

longitudinal patterns of adhesive disposed in said longitudinal marginal portions for holding said marginal portions of said first through third sections together;

a first transverse pattern of adhesive disposed adjacent said first transverse edge on said first face and first section; and said first transverse pattern of adhesive being spaced from its associated transverse edge a distance sufficient to insure that the adhesive does not interfere with rollers of a printer used to process the mailer during pausing of the printer.

2. A mailer as recited in claim 1 wherein said longitudinal patterns of adhesive comprise first and second longitudinal patterns formed in said first and second sections in said marginal patterns on said first face; and third and fourth longitudinal patterns formed in said second and third sections in said marginal patterns on said second face; said first through fourth patterns disposed so that at no point do said marginal portions have a double thickness of adhesive.

3. A mailer as recited in claim 1 wherein said first transverse pattern of adhesive is spaced from its associated transverse edge a distance of about 5/16 inch.

4. A mailer as recited in claim 1 further comprising a second transverse pattern of adhesive disposed adjacent said second transverse edge on said second face.

5. A mailer as recited in claim 4 wherein both said first and second transverse patterns are provided spaced first and second distances from said transverse edges, and wherein said distances, when said sheet is Z-folded, are each about 5/16 inches.

6. A mailer as recited in claim 5 wherein the transverse adhesive patterns are pressure sensitive adhesive, and further comprising third and fourth transverse patterns for cooperating with said first and second patterns to hold the mailer together, said third strip formed on said first face, second section, adjacent said second transverse fold line, and said fourth strip formed on said second face second section, adjacent said first transverse fold line.

7. A mailer as recited in claim 6 wherein said third and fourth transverse adhesive patterns are spaced about 5/16 inches, each from said second and first transverse fold lines, respectively.

8. A mailer as recited in claim 7 further comprising, first, second, third and fourth transverse lines of weakness adjacent to, but spaced from, said first transverse edge, said first transverse fold-line, and both sides of said second transverse fold line, and is in said first section, second section, second section, and third section, respectively; and wherein said first transverse adhesive is disposed between said first transverse edge and said first transverse line of weakness, said third transverse adhesive strip is disposed between said second fold line and said third transverse line of weakness.

9. A mailer as recited in claim 5 wherein said first and second transverse patterns of adhesive are discontinuous patterns.

10. A mailer as recited in claim 4, wherein the transverse adhesive patterns are pressure sensitive adhesive, and further comprising third and fourth transverse patterns for cooperating with said first and second patterns to hold the mailer together, said third pattern formed on said first face, second section, adjacent said second transverse fold line, and said fourth pattern formed on said second face second section, adjacent said first transverse fold line.

11. A mailer as recited in claim 10 wherein said third and fourth transverse adhesive patterns are spaced about 5/16 inches, each from said second and first transverse fold lines, respectively.

12. A mailer as recited in claim 11 further comprising, first, second, third and fourth transverse lines of weakness adjacent to, but spaced from, said first transverse edge, said first transverse fold line, and both sides of said second transverse fold line, and is in said first section, second section, second section, and third section, respectively; and wherein said first transverse adhesive is disposed between said first transverse edge and said first transverse line of weakness, said third transverse adhesive strip is disposed between said second fold line and said third transverse line of weakness.

13. A mailer type business form comprising:

a Z-folded paper sheet having first and second faces, first and second opposite longitudinal edges, and first and second transverse fold lines defining first, second and third sections of said sheet;

first and second longitudinal lines of weakness forming with said longitudinal edges first and second longitudinal marginal portions;

a first transverse edge and a second transverse edge, both parallel to said first and second fold lines;

longitudinal patterns of adhesive disposed in said longitudinal marginal portions for holding said marginal portions of said first through third sections together;

first and second transverse patterns of adhesive disposed adjacent said first and second transverse edges on said first face and first section, and second face and third section, respectively; and said first and second transverse patterns of adhesive each being spaced from said first and second transverse edges, respectively, about 5/16 inches.

14. A mailer as recited in claim 13 wherein said first and second transverse patterns of adhesives are discontinuous patterns.

15. A mailer as recited in claim 14 wherein the transverse adhesive patterns are pressure sensitive adhesive, and further comprising third and fourth transverse patterns for cooperating with said first and second patterns to hold the mailer together, said third pattern formed on said first face, second section, adjacent said second transverse fold line, and said fourth pattern formed on said second face second section, adjacent said first transverse fold line.

16. A mailer as recited in claim 13 wherein the transverse adhesive patterns are pressure sensitive adhesive, and further comprising third and fourth transverse patterns for cooperating with said first and second patterns to hold the mailer together, said third pattern formed on said first face, second section, adjacent said second transverse fold line, and said fourth pattern formed on said second face second section, adjacent said first transverse fold line.

* * * * *